US008377155B2

(12) United States Patent
Tyer

(10) Patent No.: US 8,377,155 B2
(45) Date of Patent: Feb. 19, 2013

(54) AUGER GASIFIER WITH CONTINUOUS FEED

(76) Inventor: Robert C. Tyer, Jacksonville, FL (US)

( * ) Notice: Subject to any disclaimer, the term of this patent is extended or adjusted under 35 U.S.C. 154(b) by 724 days.

(21) Appl. No.: 12/378,864

(22) Filed: Feb. 20, 2009

(65) Prior Publication Data

US 2009/0205252 A1 Aug. 20, 2009

(51) Int. Cl.
*C10J 3/54* (2006.01)
*F27B 15/09* (2006.01)

(52) U.S. Cl. ..... 48/197 R; 48/206; 48/209; 201/31; 406/55; 422/145

(58) Field of Classification Search ..... 48/62 R, 48/63, 111, 197 R, 206, 209; 201/31, 32, 201/33, 36, 38; 202/99, 118, 265; 406/55; 422/139, 145
See application file for complete search history.

(56) References Cited

U.S. PATENT DOCUMENTS 611,508 A * 9/1898 Quinn ..... 202/268
2,072,721 A * 3/1937 Rahm ..... 201/33
4,135,889 A * 1/1979 Mori ..... 48/73
4,436,588 A * 3/1984 Rammler et al. ..... 201/12
6,349,658 B1 * 2/2002 Tyer ..... 110/235
2007/0043246 A1 * 2/2007 Bridle ..... 585/240

* cited by examiner

*Primary Examiner* — Jill Warden
*Assistant Examiner* — Joye L Woodard
(74) *Attorney, Agent, or Firm* — Steven R. Scott

(57) ABSTRACT

The auger gasifier described includes, in its preferred embodiments, a vertically elongated ("oblong") primary gasifier chamber with an auger that can move up and down, allowing for large amounts of fuel input when necessary. This improvement, in turn, requires and/or is facilitated by provision for simultaneous elevation adjustments of the auger and bed dam to assure that fuel material is processed in degrees from the top downward without sweeping massive amounts of the fluidized bed materials towards the output end of the chamber. Another improvement involves provision for pressurization of the primary gasifier chamber, allowing substantial improvements in the speed of processing materials through the gasifier. Due to issues arising from thermal expansion of the refractory material lining the chamber, provision is made for nozzle and refractory imbedded pipe hole thermal expansion capability. Finally, provision is for steam injection into and/or auxiliary heating of the chamber to enhance gasification and the production of syngas.

21 Claims, 6 Drawing Sheets

IMPROVED PRESSURIZED FLUIDIZED BED AUGER GASIFIER HAVING CONTINUOUS FEED

IMPROVED PRESSURIZED FLUIDIZED BED
AUGER GASIFIER HAVING CONTINUOUS FEED

IMPROVED PRESSURIZED FLUIDIZED BED AUGER GASIFIER HAVING CONTINUOUS FEED

TOP

SIDE

CROSS SECTION OF REFRACTORY
SHOWING UNDERFIRE AIR INJECTOR (23) NOZZLE AND LOWER PIPE

IMPROVED PRESSURIZED FLUIDIZED BED
AUGER GASIFIER HAVING CONTINUOUS FEED

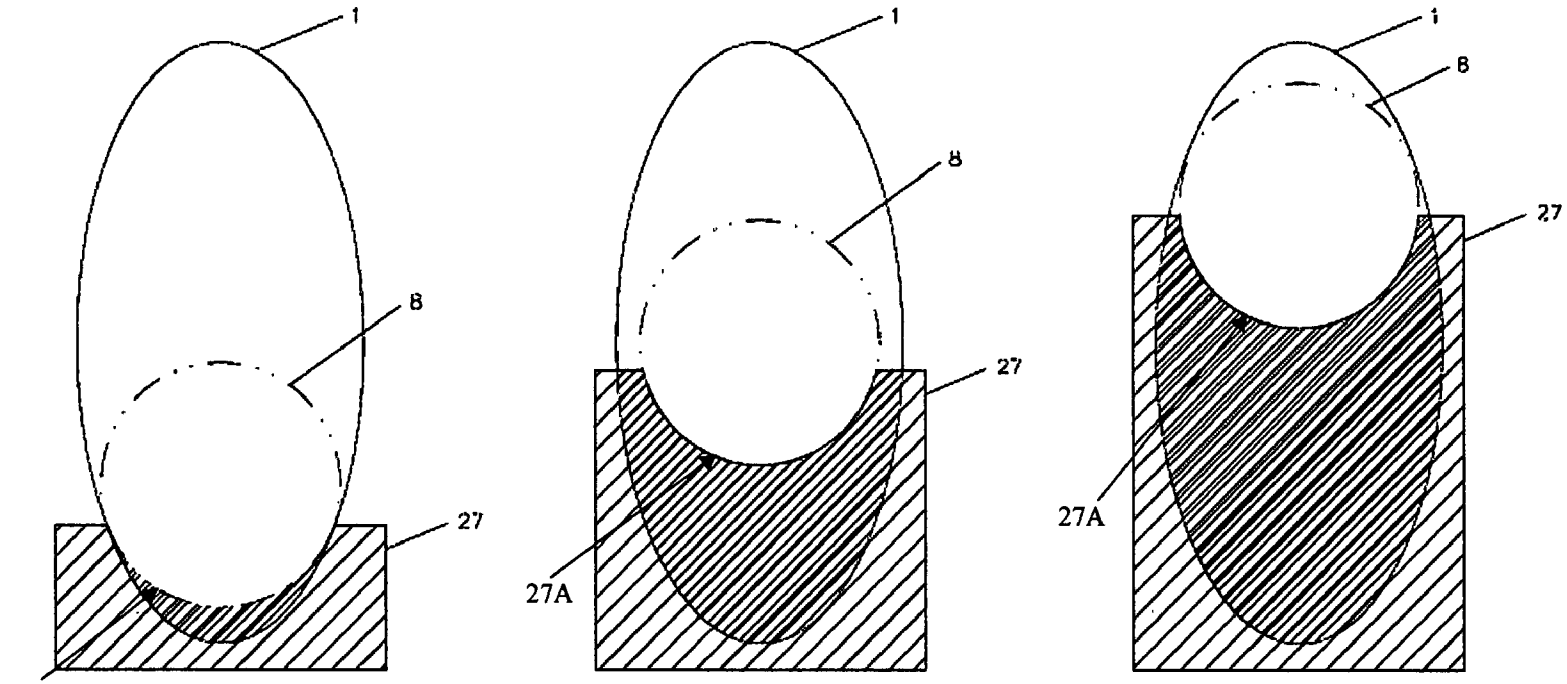
ELLIPTICAL CHAMBER WITH ADJUSTABLE BED DAM

ADJUSTABLE BED DAM ILLUSTRATION

AUGER GASIFIER WITH CONTINUOUS FEED

BACKGROUND AND SUMMARY

The invention relates generally to fluidized bed gasifiers and to the production of gasified fuel via and/or in conjunction with the gasification of solid fuels in a fluidized bed gasifier featuring a rotating auger conveyor. More particularly, it deals with improvements to the gasifier that facilitate the continuous controlled movement and gasification of solid fuels in the combustor/gasifier; and facilitate production and enrichment of gasified fuel via and in conjunction with such a gasifier. These and other improvements taught herein in relation to the operation of a gasifier represent significant advances in technology related to the environmentally sound utilization and processing of solid fuel for the production of energy via such fluidized bed gasifiers.

Much of the world's energy needs have been, and continue to be, filled by hydrocarbon fuels. In the past, such fuels provided a convenient, plentiful, and inexpensive energy source. The current rising costs of such fuels and concerns over the adequacy of their supply in the future has made them a less desirable energy source and has led to an intense investigation of alternative sources of energy. The ideal alternative energy source is a fuel which is renewable, inexpensive, and plentiful, with examples of such fuels being the byproducts of wood, pulp, and paper mills, and household and commercial refuse.

The use of such alternative energy sources is not problem-free, however, since there is reason for concern over the contents of the emissions from the combustion of such fuels as well as the environmental ramifications of acquiring and transporting the fuel and disposing of the residue of combustion. Starved-air gasifiers, wherein the air supplied for combustion is controlled in order to control temperature conditions (and the rates of combustion) so as to gasify the fuel as completely as possible, have proved very useful in the utilization of such alternative energy sources while simultaneously maintaining a high degree of environmental quality in emissions. Such starved-air gasifiers are capable of gasifying various types of fuel and producing significant amounts of syngas and heat which can be employed for any number of purposes including the production of process steam for use in manufacturing and in the generation of electricity.

Unfortunately, most starved-air gasifiers, as originally developed and operated, were not entirely satisfactory in processing the gasifiable elements of the fuel at high throughput while not producing noxious emissions. This problem resulted, in part, from the use of such gasifiers to burn a wide variety of fuels, including many which were non-homogeneous, such as household or commercial refuse. While the pollution problem can be solved to a degree by the utilization of scrubbers and other antipollution devices, such mechanisms are very expensive and their cost may militate against the use of alternative energy sources previously described.

Many of the drawbacks of such prior art devices were overcome by the development of the auger gasifier by the inventor and others. See, U.S. Pat. No. 4,009,667 (describing the original auger gasifier utilized in the system); U.S. Pat. No. 4,315,468 (describing a control means for the system); U.S. Pat. No. 4,331,084 (describing a refuse fuel feed mechanism for the system); U.S. Pat. No. 4,331,085 (describing a flame stabilization means for the system); U.S. Pat. No. 4,332,206 (describing an afterburner for the system); U.S. Pat. No. 4,332,206 (describing a hot gas recycle mechanism for use with the system); and U.S. Pat. No. 6,349,658 (describing an auger gasifier with fluidized bed. The auger gasifier technology taught and described in the foregoing patents offers a cost-effective approach to clean, efficient gasification of prepared solid waste and other solid fuels. It employs a starved-air combustion/gasification technique, ideally utilizing only limited combustion in order to gasify solid fuel in a primary chamber (the "combustor" or "gasifier" chamber).

One of the unique features of the auger gasifier system is its auger. Fuel enters the gasifier at a controlled rate and is shaped into a pile by the first auger flight. It is then pushed and tumbled through the gasifier chamber by the auger. As the auger moves the fuel through this horizontal cylinder, it stirs the material to maximize exposure for oxidation and/or gasification. The pitch of the auger can decrease along the path of material flow to accommodate the decrease of fuel bulk and retention time as the material combusts. (The use of an auger to convey fuel through the gasification cycle results in very accurately controlled movement of fuel through the gasification chamber, in comparison to alternative rotary kiln incinerators). This ability to manage fuel-bed configuration permits control of forced-draft combustion air so as to minimize combustion and gasify nearly all the fuel without complete combustion taking place, thereby allowing the gasifier to operate at what is a uniformly moderate temperature from auto-ignition to desired exit gas temperature.

The combination of fuel bed stirring and air injection with precise temperature control gives the auger gasifier system several advantages over prior technology: Reliability and clean operation; high throughput; low gasifier temperature: longer material life (refractory and auger); fully automatic control; and the ability to combust a wide variety of heterogeneous solid fuels. However, several of these advantages are further strengthened by creation of a fluidized bed via the high pressure input of underfire air into the system via a large plurality of input holes. The fluidized bed can be formed in whole or in part by the addition of a substrate of appropriate granular materials or it can be comprised solely of materials in the gasification process. In either case it acts as an "air bearing" in the auger combustor/gasifier chamber, aiding in the diffusion of gasification air through the material being burned as more fully described in U.S. Pat. No. 6,349,658.

Still, while the auger combustor/gasifier described in the foregoing patents offers a cost-effective approach to clean, efficient gasification, I have found that various innovative improvements, as further taught herein, support and facilitate its operations and efficiency. These improvements include provision of a vertically elongated ("oblong") primary gasifier chamber with an auger that can move up and down, allowing for large amounts of fuel input when necessary. This improvement, in turn, requires and/or is facilitated by provision for simultaneous elevation adjustments of the auger and bed dam to assure that fuel material is processed in degrees from the top downward without sweeping massive amounts of the fluidized bed materials towards the output end of the chamber. Another improvement involves provision for pressurization of the primary gasifier chamber, allowing substantial improvements in the speed of processing materials through the gasifier. Due to issues arising from thermal expansion of the refractory material lining the chamber, I have also made provision for nozzle and refractory imbedded pipe hole thermal expansion capability. To these I have added provision for steam injection into and/or auxiliary heating of the chamber to enhance gasification and the production of syngas. These changes and improvements serve to create an even more efficient and cost effective system which is well adapted to meet the continuing needs of our modern technological civilization for elimination of waste while producing clean environmentally sound sources of alternative energy therefrom.

BRIEF DESCRIPTION OF THE DRAWINGS

FIG. 5A provides a schematic cross-sectional view showing an auger with adjustable dam positioned near the bottom of an auger gasifier chamber having an elliptical cross-section.

FIG. 5B provides a schematic cross-sectional view showing an auger with adjustable dam positioned near the middle of an auger gasifier chamber having an elliptical cross-section.

FIG. 5C provides a schematic cross-sectional view showing an auger with adjustable dam positioned near the top of an auger gasifier chamber having an elliptical cross-section.

DESCRIPTION

Figure 1:
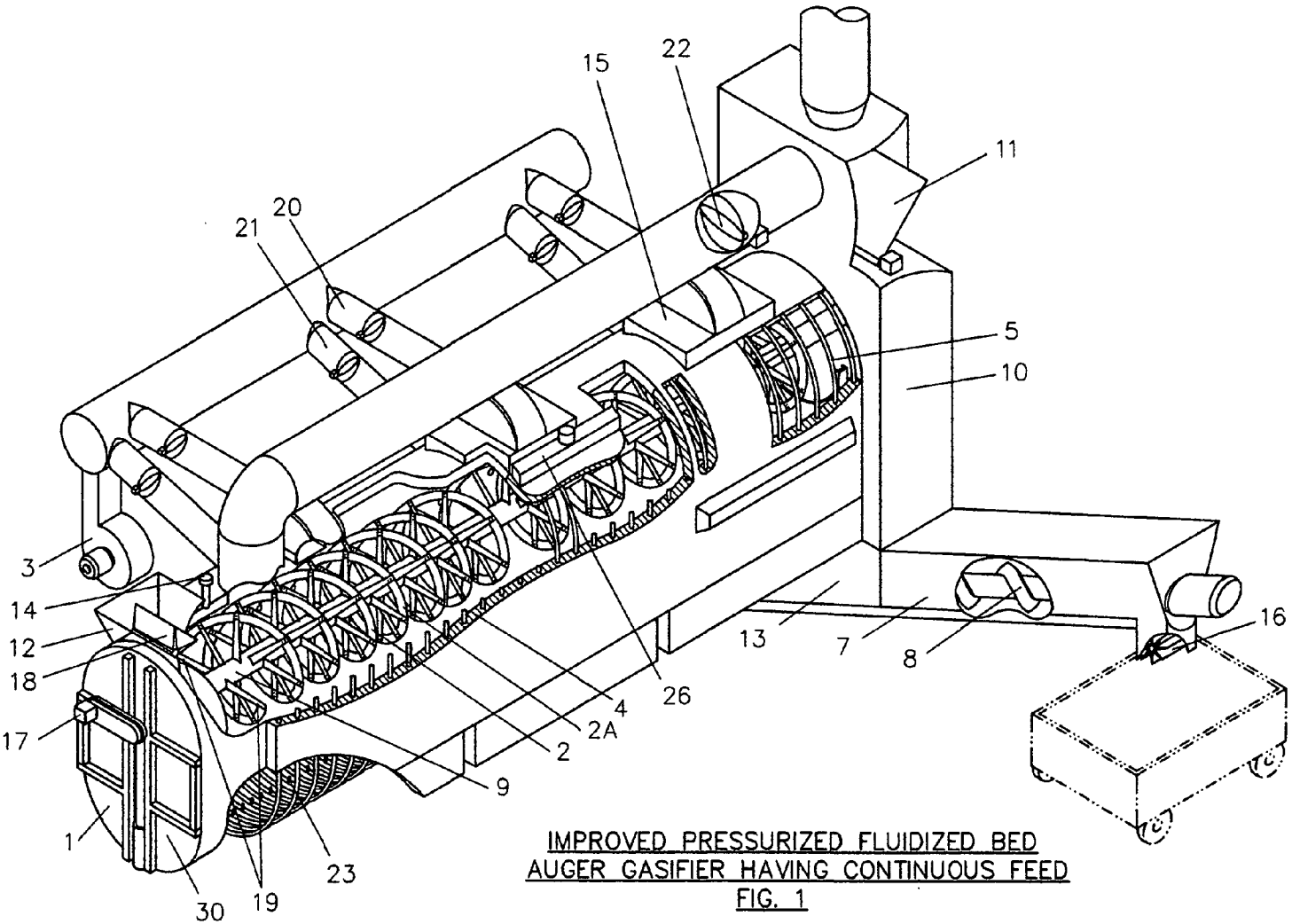
FIG. 1 is a perspective view of an auger gasifier in accordance with the teachings of the invention with auger in a raised position and portions removed to provide a better view of interior components thereof.

Turning first to FIG. 1, it will be seen that the gasifier chamber of a rotary auger gasifier produced in accordance with the teachings of this invention (hereinafter referred to as "chamber 1" and denoted generally by arrow 1) may be generally described as a hollow, horizontally disposed, stationary, elongate vessel having an upper and a lower side (bottom 7). In the prior versions of chamber 1 of my invention, chamber 1 took the form of a cylinder. However, the improved version of chamber 1 taught herein, as discussed in more detail below, has an oblong or elliptical cross-section. Chamber 1 has an inlet end 30 into which combustible refuse is fed via an inlet hopper 12. It likewise has an outlet end 10 connected to an ash receptacle 13 from which ash can be removed via a helical screw conveyor 8.

Figure 4:
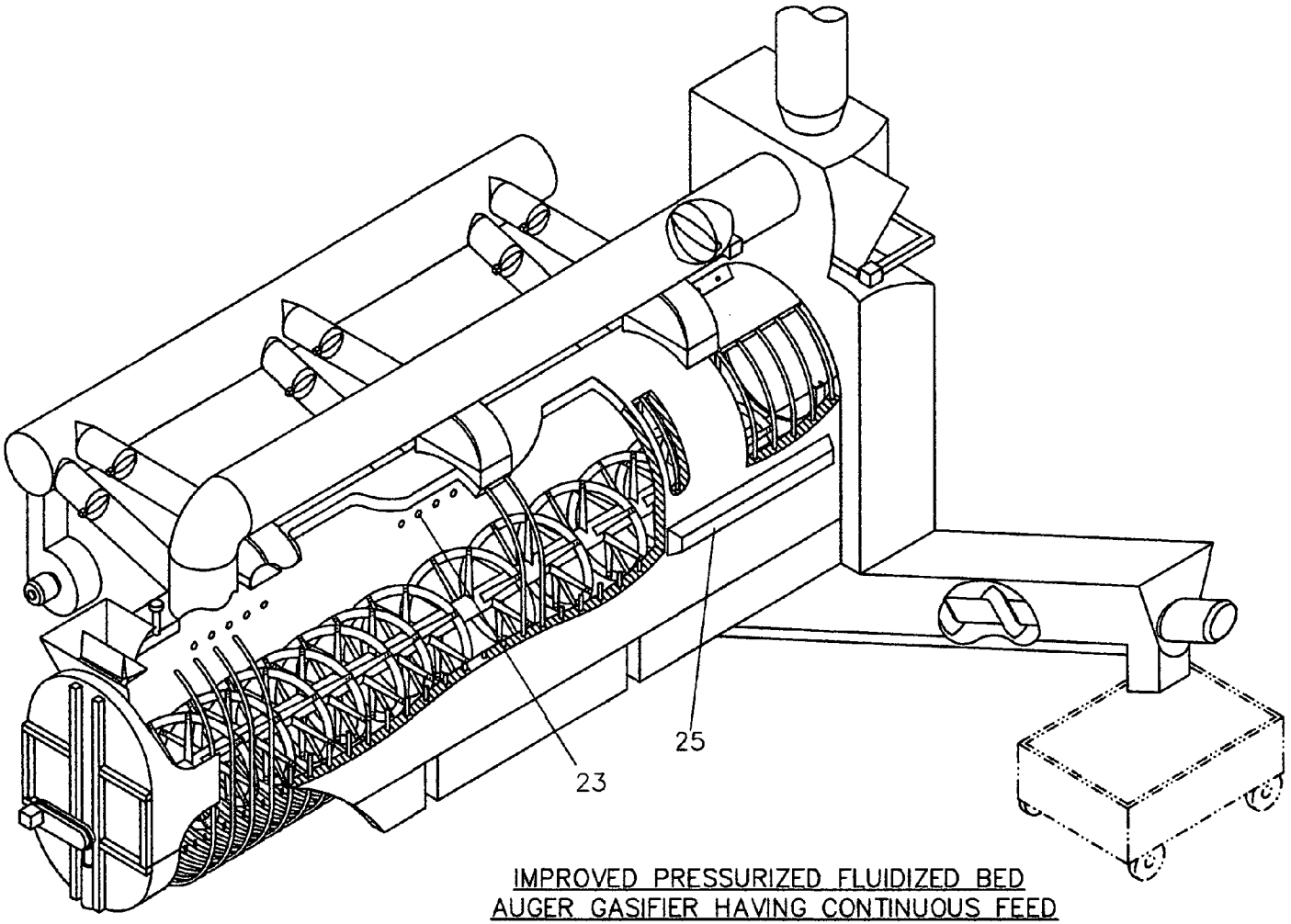
FIG. 4 is a perspective view of the auger gasifier of FIG. 1 with auger in a lowered position and portions removed to provide a better view of interior components thereof.
Figures 6A, 6B, 6C:
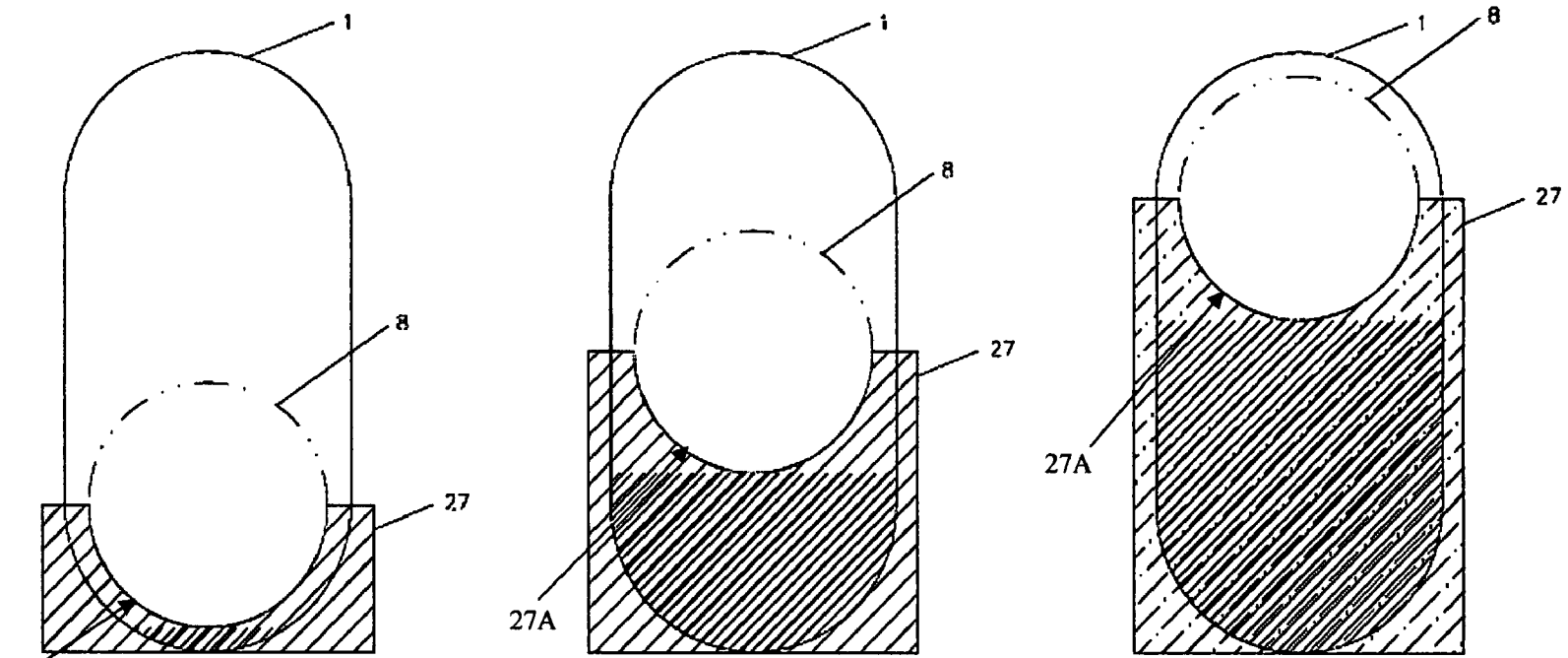
FIG. 6A provides a schematic cross-sectional view showing an auger with adjustable dam positioned near the bottom of an auger gasifier chamber having an oblong cross-section.
FIG. 6B provides a schematic cross-sectional view showing an auger with adjustable dam positioned near the middle of an auger gasifier chamber having an oblong cross-section.
FIG. 6C provides a schematic cross-sectional view showing an auger with adjustable dam positioned near the top of an auger gasifier chamber having an oblong cross-section.

Extending the length of the gasifier chamber 1 is a rotatable screw conveyor 8 which can be preferably provided by a rotatable auger 8 having a tubular axis 9. The spiral flights 2 of the auger 8 extend from the front wall to the outlet end 10, so that when the auger 8 is rotated, the auger flights 2 will convey and tumble gasifiable refuse entering inlet end 30 from the feed hopper 12 through the gasification chamber 1, and deliver the solid residue to the ash receptacle 13 at outlet end 10 where it can be removed via helical screw conveyor 8. In prior embodiments as well as in the embodiments illustrated, the tubular axis 9 can be raised/lowered and positioned anywhere between the top of chamber 1 (as shown in FIG. 1) and the bottom 7 of chamber 1 (as shown in FIG. 4). The auger flights 2 are comprised of individual segments which are joined together and concentrically spaced from the tubular auger shaft or axis 9 by a plurality of support members, so that an open annular space is formed between the inner edge of the auger flights 2 and the auger shaft (axis 9). This open space allows air to freely move upward and circulate through the gasifier chamber 1 as well as along the auger axis 9.

Chamber 1 also includes air supply means such as blower 3 for supplying underfire air and overfire air for gasification and provision of a fluidized bed. As is typical of prior embodiments, a plurality of overfire air conduits and underfire air conduits supply air to chamber 1, with underfire air being provided via air distribution pipes 5 from a hot air manifold 15 in a heat exchange relationship with chamber 1. Nozzles 6 in communication with pipes 5 provide an outlet for this air beneath any fuel or non-fuel particle bed in chamber 1 and serve to fluidize such bed. In addition, the underfire air, which is at an elevated temperature due to its pre-heating while passing through manifold 5 and refractory 4, contributes to the gasification of fuel in the bed as well as heating and drying the fuel. A bed dam 27 (with bed dam gap 27A) proximate bottom 7 and outlet end 10 prevents particles of fuel or otherwise forming said fluidized bed from being swept from the chamber 1 when auger 8 is rotated to move and tumble said gasifiable materials from the inlet end 30 to said outlet end 10.

One of the notable improvements embodied herein is, as previously noted, the provision of a chamber 1 that is oblong in cross-section (as illustrated in FIGS. 1, 4, and 6A through 6C) or elliptical in cross-section (as illustrated in FIGS. 5A through 5C), having—in either case—a vertical diameter greater than its horizontal diameter. When oblong in cross-section, chamber 1 forms a stretched cylinder having a vertical diameter greater than its horizontal diameter, straight vertical sides, and upper and lower sides (top and bottom 7) that are semi-cylindrical in cross-section. When elliptical in cross-section, chamber 1 forms a stretched cylinder having a vertical diameter greater than its horizontal diameter, somewhat curved vertical sides, and upper and lower sides (top and bottom 7) that remain semi-cylindrical in cross-section. When chamber 1 is oblong in cross-section, auger 8 preferably has a width that is slightly less than the horizontal diameter of chamber 1, such that the distance between auger 8 and inner sides of chamber 1 remains constant when the rotatable auger 8 is moved up and down. When chamber 1 is elliptical in cross-section, auger 8 preferably has a width that is slightly less than the horizontal diameter of chamber 1 at the top and bottom 7, such that the distance between auger 8 and inner sides of chamber 1 is constant at the top and bottom 7, but otherwise varies when the rotatable auger 8 is moved up and down.

Figure 2:
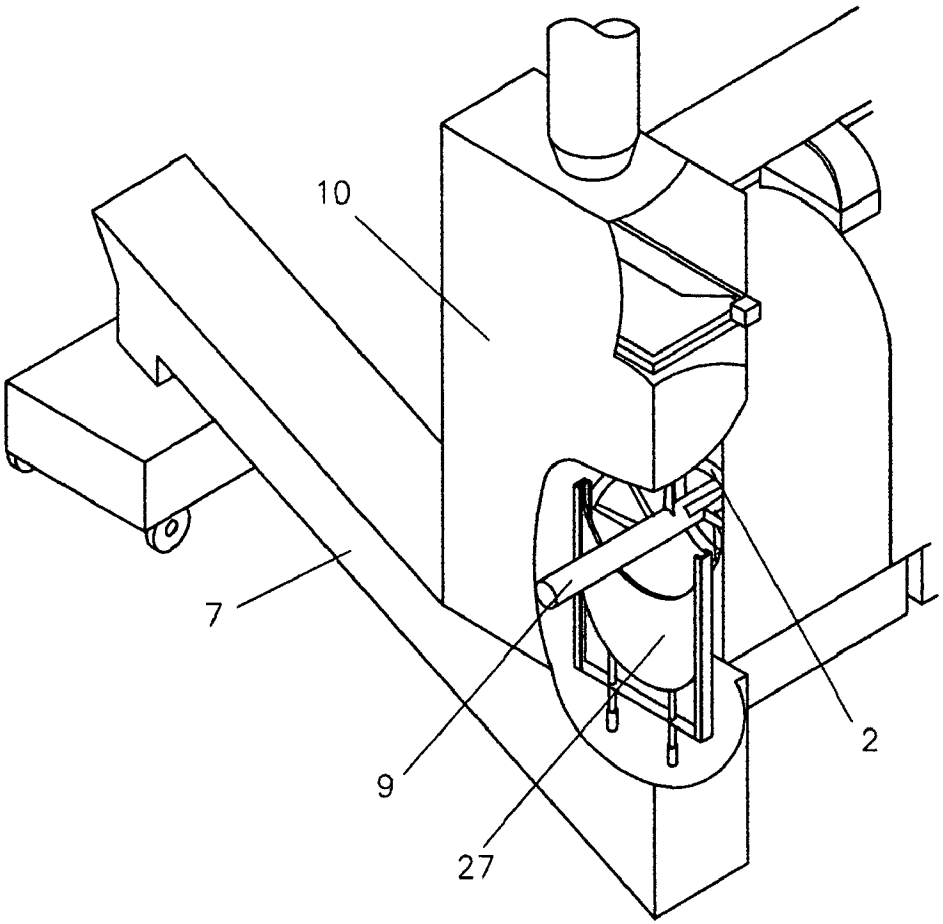
FIG. 2 is a perspective view of an end of the auger gasifier illustrated in FIG. 1 with portions removed to provide a better view of the vertically adjustable bed dam thereof.
Figure 3A:
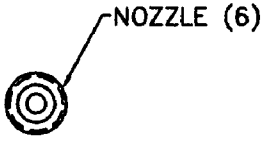
FIG. 3A provides a top cross-sectional view of an underfire air injector in accordance with the teachings of the invention.
Figure 3B:
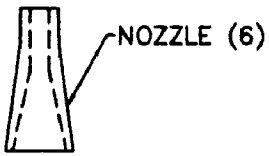
FIG. 3B provides a side cross-sectional view of the underfire air injector illustrated in FIG. 3A.
Figure 3C:
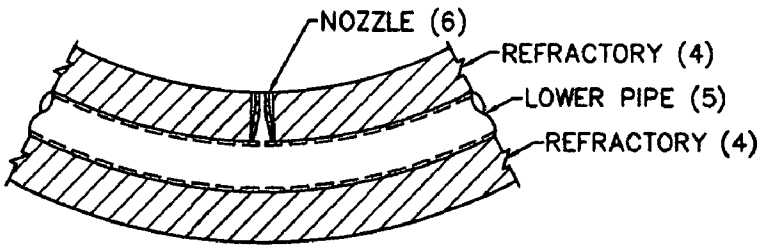
FIG. 3C provides a cross-sectional view illustrating the underfire air injector of FIGS. 3A and 3B positioned in refractory material lining sides of the auger gasifier in communication with the interior of the auger gasifier and a curvilinear air distributing means thereof.

The oblong configuration is preferred, but both configurations allow substantial variation in one or both the depth of the fluidized bed in the chamber 1 and the depth of the gasifiable materials in the chamber 1. This is extremely beneficial for a variety of purposes. One reason is because a much greater quantity of fuel can be processed and gasified in chamber 1 at the same time, with the auger 8 (which can be raised and lowered to accommodate fuel bed level variations as necessary) being capable of distributing said fuel throughout chamber 1 and selectively removing fuel residue from the top-most layers thereof selectively. In addition, this along with other features of the invention allow more continuous processing of fuels as the ability of chamber 1 to handle varying amounts of batch loaded fuel enable the system to more easily remain in continuous operations. Finally, in order to better accommodate the aforesaid changes to the cross-section of chamber 1, it is highly beneficial to provide a bed dam 27 that can be raised and lowered in conjunction with the raising and lowering of auger 8 as best illustrated in FIGS. 2, 5 and 6. This improvement assures that fuel material can be processed in degrees from the top downward without sweeping massive amounts of fluidized bed materials towards the output end 10 of chamber 1.

Another improvement made, is the addition of at least one additional plurality of sequential supplemental spiral flights 2A disposed around axis 9 proximate inlet end 30 in such manner that supplemental spiral flights 2A likewise form a continuous helix around axis 9 intermediate the previously described spiral flights 2 of auger 8. This allows for (in the case of one additional set of supplemental spiral flights 2A) twice the tumbling of fuel bed material being moved by auger 8 while being moved over the same distance, exposing more of said materials for gasification purposes. This is beneficial to the gasification process overall and particularly assists in the more rapid out-gassing of volatiles (including water vapor) while fuel is still proximate inlet end 30.

In addition, 1 have found it very beneficial in terms of the more rapid processing and gasification of fuels in chamber 1 to be able to control the pressure in chamber 1 as necessary for more rapid gasification and processing of various fuel types, and more particularly, to be able to keep chamber 1 at an elevated pressure (requiring chamber 1 to serve as a pressure vessel). Overall, the interior of said chamber will be maintained at a pressure of at least atmospheric pressure, but less than the engineered limits of chamber 1 as a pressure vessel. However, it has been found to be advantageous in the rapid gasification of fuel to be able to maintain chamber 1 pressure at or above approximately 2 atmospheres (i.e., approximately at least 30 psi). Obviously, in order to control pressure in chamber 1, provision must be made to control ingress and egress of gases from chamber 1 via the inlets and outlets for an auger gasifier chamber 1. I have found that this can be accomplished by providing and using, as necessary, rotary lock valves 16 and 18 at, respectively, the waste/ash outlet for chamber 1 and inlet hopper 12, and control valves such as underfired air control valve 20, overfired air control valve 21, flame stabilization duct valve 22, and outlet valve 11, at gas inlets and outlets to chamber 1. However, even when pressure is elevated, proper gasification is facilitated by a starved air environment. Thus, the oxygen content maintained in the chamber 1 interior should be held ideally at the lowest ratio that will maintain stability of the gasification process, but not more than 50% of the oxygen content necessary for combustion of the contents thereof.

A further improvement is based on my finding that thermal expansion of air distribution pipes 5 may displace the openings by which said pipes 5 feed pressurized air to channels 6 into chamber 1 such that the two are no longer aligned, deleteriously effecting the input of pressurized air to chamber 1 necessary for gasification and the production of a fluidized bed. As previously noted, the interior of chamber 1 is lined with a refractory material 4, with air distribution pipes 5 imbedded in said refractory material 4 to form the air distribution conduits in communication with the plurality of openings in the lower side (bottom 7) of chamber 1. Channels 6 through said refractory 4 intermediate air distribution pipes 5 and the interior of the chamber 1 communicate pressurized air to the interior of the chamber 1. In order to handle the aforesaid problem, I have made the apertures of said channels in communication with adjacent apertures in said pipes larger than the adjacent apertures in said pipes 5, allowing for shifts in the location of said pipe apertures due to thermal expansion. In addition, as an added change, channels 6 now form nozzles (being narrowed proximate chamber 1), creating a venturi effect to accelerate a jet of pressurized air issuing from the channels/nozzles into chamber 1.

Finally, I have added additional heat source(s) such as external heater 25 (which may be electric) and provides supplemental heating to the gas stream in chamber 1 (in addition to any heat generated by combustion and gasification of the fuel therein). In addition, I have added a supplemental source of steam such as steam reforming means 26, providing supplemental steam to the gas stream in chamber 1 (in addition to any generated by combustion and gasification of the aforesaid fuel). These both can assist in the production of syngas from said gas stream, with syngas being one of the major products sought through gasification, and serving as a base for further processing by, for example, the Fisher-Tropsch process.

However, numerous variations are possible without deviating from and/or exceeding the spirit and scope of the inventive concept. Moreover, many of the above-disclosed and other features and functions, or alternatives thereof, may be desirably combined into various other different systems or applications. Also, numerous presently unforeseen or unanticipated alternatives, modifications, variations or improvements therein may be subsequently made by those skilled in the art which are also intended to be encompassed by the claims that follow.

Finally, the following parts list for the drawing figures may be found to be of assistance in understanding more fully the concepts of my invention:

1 Horizontally disposed stationary cylindrical fluidized bed gasifier chamber
2 Spiral flight(s)
2A Supplemental spiral flight(s)
3 Air supply means
4 Refractory material
5 Curvilinear air distributing pipes
6 Air distributing nozzles
7 Semicircular bottom
8 Helical screw conveyor
9 Tubular axis
10 Outlet end
11 Outlet valve
12 Inlet hopper
13 Ash receptacle
14 Ignition means
15 Hot air manifold
16 Rotary lock valve
17 Variable speed drive device
18 Rotary lock valve
19 Double lead flight
20 Underfired air control valve
21 Overfired air control valve
22 Flame stabilization duct valve
23 Underfire air injector
24 Overfired air injector
25 External heater means
26 Steam reforming means
27 Bed dam
27A Bed dam gap
30 Inlet end

What is claimed is:

1. A gasification method, comprising:

providing a gasifier comprising an elongated horizontally disposed stationary gasifier chamber, said chamber having a first end with an inlet for receiving gasifiable materials into its interior and a second end with outlets for discharging a gas stream and a solid residue remaining after gasification of said gasifiable materials, the horizontal position of said elongated stationary chamber defining an upper and a lower side, with a plurality of openings in the lower side, a rotatable screw conveyor extending through said chamber's interior from proximate said first end to proximate said second end for moving materials therethrough, which said screw conveyor can be raised and lowered in relation to the lower side of the chamber, a plurality of particles disposed in the interior of said chamber means above the plurality of openings in the lower side thereof, a plurality of air distribution conduits in communication with said plurality of openings in the lower side of the chamber supplied with pressurized air from a pressurized air supply source such that said pressurized air supply source is in direct communication with the interior of the chamber via said plurality of openings in the lower side thereof, said plurality of air distribution conduits emitting air into the interior of the chamber from said pressurized air supply source through said plurality of openings at pressures sufficient to substantially fluidize the particles located above said plurality of openings to form a fluidized bed, a bed dam proximate said lower side and second end that can be raised and lowered in conjunction with said screw conveyor, and wherein said chamber has a vertical diameter greater than its horizontal diameter; and gasifying materials placed in said gasifier so as to generate the gas stream and the solid residue remaining after gasification of said gasifiable materials, including supplying air and gasifiable materials to said gasifier, including inputting air via said plurality of openings so as to substantially fluidize said particles and form a fluidized bed, and inputting a batch of gasifiable materials into the interior of the gasifier chamber via said inlet and elevating the rotatable screw conveyor as necessary to accommodate said materials, rotating and lowering said rotatable screw conveyor as necessary to assure full gasification while moving and tumbling said batch of gasifiable materials from said first end to said second end as they are gasified while using said fluidized bed to support said gasifiable materials as they are moved from said first end to said second end, and discharging solid residue through a gap in said bed dam while using said bed dam to prevent particles forming said fluidized bed from being swept from the chamber when said screw conveyor is rotated to move and tumble said gasifiable materials from said first end to said second end, said bed dam being raised and lowered in conjunction with said screw conveyor.

2. The gasification method of claim 1, wherein the shape of said chamber allows substantial variation in at least one of depth of the fluidized bed in the chamber, and depth of the combustible gasifiable materials in the chamber.

3. The gasification method of claim 2, further comprising at least one additional plurality of sequential supplemental spiral flights disposed around said axial member proximate said first end in such manner that said supplemental spiral flights form a continuous helix around said axial member intermediate the aforesaid spiral flights proximate said first end.

4. The gasification method of claim 3, further comprising at least one of providing an additional artificial heat source providing supplemental heating to the gas stream produced by said gasifier in addition to any heat generated by gasification of the aforesaid gasifiable materials, and providing a supplemental source of steam to the gas stream produced by said gasifier in addition to any generated by gasification of the aforesaid gasifiable materials, said supplemental heating or steam assisting in the production of syngas from said gas stream.

5. The gasification method of claim 1, wherein said chamber is oblong in cross-section, said screw conveyor has a width defining a screw conveyor diameter, said screw conveyor diameter is slightly less than the horizontal diameter of said chamber, and the distance between said screw conveyor and inner sides of said chamber remains constant when said rotatable screw conveyor is raised and lowered.

6. The gasification method of claim 5, further comprising at least one additional plurality of sequential supplemental spiral flights disposed around said axial member proximate said first end in such manner that said supplemental spiral flights form a continuous helix around said axial member intermediate the aforesaid spiral flights proximate said first end.

7. The gasification method of claim 5, further comprising at least one of providing an additional artificial heat source providing supplemental heating to the gas stream produced by said gasifier in addition to any heat generated by gasification of the aforesaid gasifiable materials, and providing a supplemental source of steam to the gas stream produced by said gasifier in addition to any generated by gasification of the aforesaid gasifiable materials, said supplemental heating or steam assisting in the production of syngas from said gas stream.

8. The gasification method of claim 1, wherein said chamber is elliptical in cross-section, said screw conveyor has a width defining a screw conveyor diameter, said screw conveyor diameter is slightly less than the horizontal diameter of said chamber, and the distance between said screw conveyor and inner sides of said chamber varies when said rotatable screw conveyor is raised and lowered based on the particle size.

9. The gasification method of claim 1, wherein said screw conveyor comprises at least one of: an axial member having two ends with a plurality of spiral flights forming a continuous helix around said axial member, and an axial member having two ends with a plurality of spiral flights forming a continuous helix around said axial member and at least one additional plurality of sequential supplemental spiral flights disposed around said axial member proximate said first end in such manner that said supplemental spiral flights form a continuous helix around said axial member intermediate the aforesaid spiral flights proximate said first end.

10. The gasification method of claim 9, further comprising maintaining the interior of said chamber at a pressure of at least atmospheric pressure.

11. The gasification method of claim 9, further comprising at least one of providing an additional artificial heat source providing supplemental heating to the gas stream produced by said gasifier in addition to any heat generated by gasification of the aforesaid gasifiable materials, and providing a supplemental source of steam to the gas stream produced by said gasifier in addition to any generated by gasification of the aforesaid gasifiable materials, said supplemental heating or steam assisting in the production of syngas from said gas stream.

12. The gasification method of claim 1, further comprising maintaining the interior of said chamber at a pressure of at least atmospheric pressure.

13. The gasification method of claim 12, further comprising maintaining the interior of said chamber at a pressure of at least 30 psi.

14. The gasification method of claim 12, further comprising maintaining the interior of said chamber under pressure at least in part by controlling ingress of gases at selected inlets and egress of gases at selected outlets for said chamber.

15. The gasification method of claim 14, further comprising controlling ingress and egress of gases at said selected inlets and selected outlets for said chamber by at least one of: rotary lock valves at said selected inlets and outlets and control valves at said selected inlets and outlets.

16. The gasification method of claim 12, further comprising maintaining the oxygen content in said chamber interior at the lowest ratio that will maintain stability of the gasification process and not more than 50% of the oxygen content necessary for combustion of the contents thereof.

17. The gasification method of claim 12, further comprising at least one of providing an additional artificial heat source providing supplemental heating to the gas stream produced by said gasifier in addition to any heat generated by gasification of the aforesaid gasifiable materials, and providing a supplemental source of steam to the gas stream produced by said gasifier in addition to any generated by gasification of the aforesaid gasifiable materials, said supplemental heating or steam assisting in the production of syngas from said gas stream.

18. The gasification method of claim 1, wherein the interior of said chamber is lined with a refractory material, air distribution pipes imbedded in said refractory material form the air distribution conduits in communication with the plurality of openings in the lower side of the chamber, channels through said refractory intermediate said air distribution pipes and the interior of the chamber are formed as nozzles communicating pressurized air to the interior of the chamber, and apertures of said nozzle are in communication with and larger than adjacent apertures in said pipes allowing for shifts in the location of said pipe apertures due to thermal expansion.

19. The gasification method of claim 18, wherein apertures of said nozzles in communication with the interior of said chamber are narrowed, creating a venturi effect to accelerate a jet of pressurized air issuing from the nozzles into the chamber.

20. The gasification method of claim 18, further comprising at least one of providing an additional artificial heat source providing supplemental heating to the gas stream produced by said gasifier in addition to any heat generated by gasification of the aforesaid gasifiable materials, and providing a supplemental source of steam to the gas stream produced by said gasifier in addition to any generated by gasification of the aforesaid gasifiable materials, said supplemental heating or steam assisting in the production of syngas from said gas stream.

21. The gasification method of claim 1, further comprising at least one of providing an additional artificial heat source providing supplemental heating to the gas stream produced by said gasifier in addition to any heat generated by gasification of the aforesaid gasifiable materials, and providing a supplemental source of steam to the gas stream produced by said gasifier in addition to any generated by gasification of the aforesaid gasifiable materials, said supplemental heating or steam assisting in the production of syngas from said gas stream.

* * * * *